US011781554B2

(12) United States Patent
Li

(10) Patent No.: US 11,781,554 B2
(45) Date of Patent: Oct. 10, 2023

(54) LIFTING OSCILLATING FAN WHICH IS CONVENIENT TO STORE AND CARRY

(71) Applicant: SHENZHEN HEBRON TECHNOLOGY CO., LTD, Shenzhen (CN)

(72) Inventor: Ai Li, Shenzhen (CN)

(73) Assignee: SHENZHEN HEBRON TECHNOLOGY CO., LTD, Shenzhen (CN)

( * ) Notice: Subject to any disclaimer, the term of this patent is extended or adjusted under 35 U.S.C. 154(b) by 40 days.

(21) Appl. No.: 17/625,629

(22) PCT Filed: Mar. 13, 2020

(86) PCT No.: PCT/CN2020/079094

§ 371 (c)(1),
(2) Date: Jan. 7, 2022

(87) PCT Pub. No.: WO2021/155623

PCT Pub. Date: Aug. 12, 2021

(65) Prior Publication Data

US 2022/0252077 A1 Aug. 11, 2022

(30) Foreign Application Priority Data

Feb. 6, 2020 (CN) ..... 202020154580.0

(51) Int. Cl.

| | |
|---|---|
| ***F04D 25/10*** | (2006.01) |
| ***F04D 29/00*** | (2006.01) |
| ***F04D 27/00*** | (2006.01) |

(52) U.S. Cl.
CPC ..... *F04D 25/105* (2013.01); *F04D 29/002* (2013.01); *F04D 27/00* (2013.01)

(58) Field of Classification Search
CPC ..... F04D 25/10; F04D 25/105
See application file for complete search history.

(56) References Cited

FOREIGN PATENT DOCUMENTS

| | | | |
|---|---|---|---|
| CN | 104632668 | * | 5/2015 |
| CN | 107355404 | * | 11/2017 |
| CN | 110285085 | * | 9/2019 |
| CN | 110374903 | * | 10/2019 |
| CN | 210716820 | * | 6/2020 |
| WO | WO-2021022798 A1 | * | 2/2021 |

* cited by examiner

*Primary Examiner* — Brian O Peters
(74) *Attorney, Agent, or Firm* — Li & Cai Intellectual Property (USA) Office

(57) ABSTRACT

A lifting oscillating fan comprises a fan base. One side of upper end of the fan base is connected to a first telescopic rod; upper end of the first telescopic rod is connected to a second telescopic rod by a movable joint; upper end of the second telescopic rod is connected to a U-shaped support; inner walls of opposite sides of the U-shaped support are connected to a rotating rod by a rotating shaft; upper end of the rotating rod is connected to a supporting rod by a bearing; a head shaking support is sheathed on upper end of the supporting rod; one side of the head shaking support is connected to a connecting plate; the head shaking support is connected to a fan head by the connecting plate; and a connecting cylinder correspondingly connected to the connecting plate is embedded in one side of the fan head.

6 Claims, 4 Drawing Sheets

LIFTING OSCILLATING FAN WHICH IS CONVENIENT TO STORE AND CARRY

FIELD OF THE DISCLOSURE

The present disclosure relates to the technical field of fans, in particular, to a lifting oscillating fan which is convenient to store and carry.

BACKGROUND OF THE DISCLOSURE

Fan refers to an appliance used to generate wind and cool in hot weather. An electric fan is a device that is driven by electricity to generate air flow. The fan inside is energized and then turned into natural wind to achieve the effect of cooling off.

At present, there is a lifting and shaking head fan on the market, which is convenient for people to blow and dissipate heat in all directions. However, this fan has a fixed form and a large volume. When it is actually carried, it takes up a lot of space and is not convenient for people to carry and use.

SUMMARY OF THE DISCLOSURE

The primary purpose of the present disclosure is to solve the problem that the lifting and shaking head fan in the prior art has a fixed form, large volume, and takes up a lot of space when actually carried, and is not convenient for people to carry, so the present disclosure provides a lifting oscillating fan which is convenient to store and carry.

In order to achieve the above objectives, the present disclosure adopts the following technical solutions.

A lifting oscillating fan which is convenient to store and carry is provided, comprising: a fan base, wherein one side of an upper end of the fan base is fixedly connected to a first telescopic rod; an upper end of the first telescopic rod is rotatably connected to a second telescopic rod by means of a movable joint; an upper end of the second telescopic rod is fixedly connected to a U-shaped support; inner walls of the opposite sides of the U-shaped support are rotatably connected to a rotating rod by means of a rotating shaft; an upper end of the rotating rod is rotatably connected to a supporting rod by means of a bearing; a head shaking support is sheathed on an upper end of the supporting rod in a fixed manner; one side of the head shaking support is fixedly connected to a connecting plate; the head shaking support is fixedly connected to a fan head by means of the connecting plate; and a connecting cylinder which is correspondingly connected to the connecting plate is fixedly embedded in one side of the fan head; a motor is arranged on an outer side of the head shaking support, an output shaft of the motor is fixedly connected to the head shaking support, and an outer wall of the fan head is further fixedly connected with a fan rear shell that is arranged outside the head shaking support.

In a preferred embodiment, an upper surface of the fan base is further provided with a remote control and an operation button, and the operation button is electrically connected to the motor by means of the remote control.

In a preferred embodiment, a side wall of the fan base is further provided with a charging interface.

In a preferred embodiment, an upper surface of the fan base is further provided with a placement groove for placing the fan head.

In a preferred embodiment, a dust-proof rubber pad is connected to the fan base corresponding to the charging interface.

In a preferred embodiment, a plurality of heat dissipation holes are uniformly opened on a surface of the fan rear shell.

Compared with the prior art, the present disclosure provides a lifting oscillating fan which is convenient to store and carry, and has the following beneficial effects.

1. The lifting oscillating fan which is convenient to store and carry can quickly and conveniently adjust the relative height of the fan head by means of the first telescopic rod and the second telescopic rod, and the fan head can be moved back and forth by means of the cooperation of the motor and the head shaking support, which is convenient for people to use for blowing air, and when the overall fan needs to be moved, the first telescopic rod and the second telescopic rod are received to the shortest position, then the position of the fan head is rotated by the rotating connection of the movable joint so that the fan head is clamped down into the placement groove on the surface of the fan base, and then the fan can be quickly folded, which greatly reduces the overall volume of the fan and is convenient for people to carry and use.

2. The lifting oscillating fan which is convenient to store and carry can charge the fan by means of the provided charging interface, and the provided dust-proof rubber pad can prevent the problem of dust from entering the charging interface for use when it is not required to be used for charging.

Moreover, the parts not involved in the device are the same as the prior art or can be embodied by using the prior art. The present disclosure can embody the rapid folding of the fan, greatly reduce the overall volume of the fan, and is convenient for people to carry and use.

Figure 1:
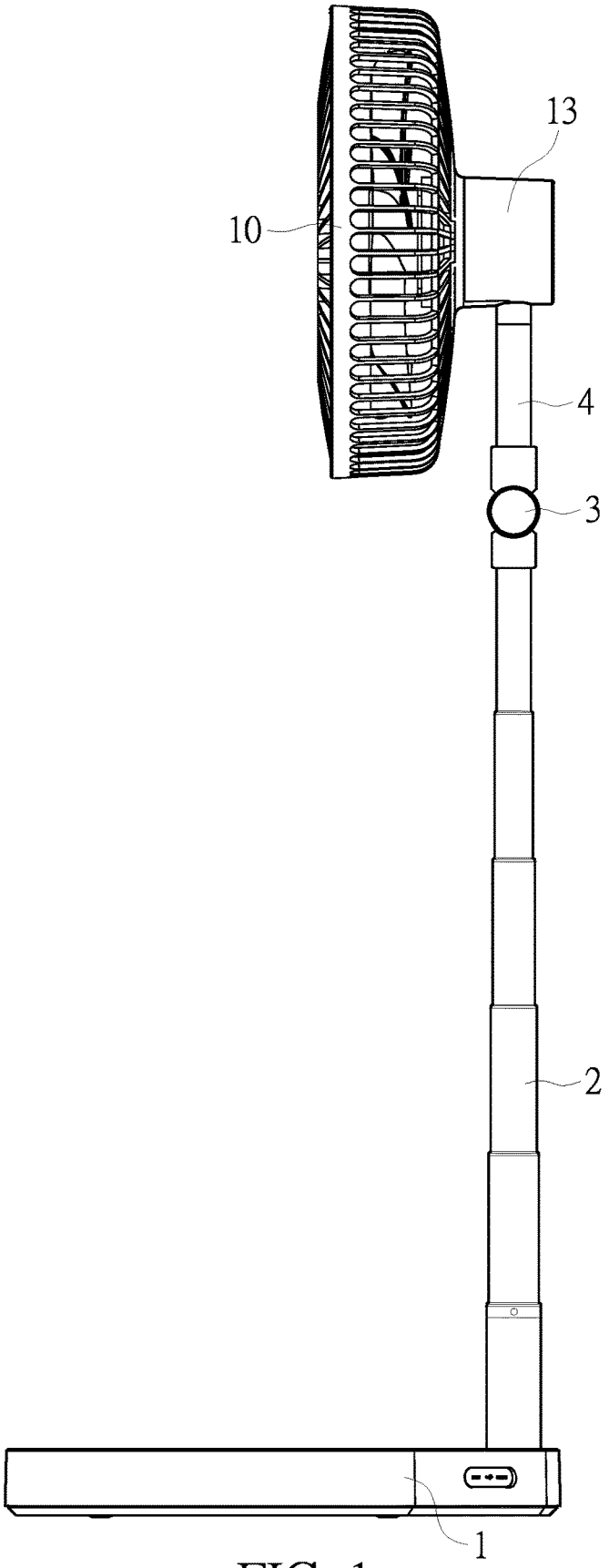
FIG. 1 is a schematic structural diagram of a lifting oscillating fan which is convenient to store and carry proposed by the present disclosure.

Reference numeral: 1. fan base, 2. first telescopic rod, 3. movable joint, 4. second telescopic rod, 5. U-shaped support, 6. rotating rod, 7. supporting rod, 8. head shaking support, 9. connecting plate, 10. fan head, 11. connecting cylinder, 12. motor, 13. fan rear shell, 14. remote control, 15. operation button, 16. charging interface, 17. placement groove.

DETAILED DESCRIPTION OF THE EXEMPLARY EMBODIMENTS

The following will clearly and completely describe the technical solutions in the embodiments of the present utility model in conjunction with the accompanying drawings in the embodiments of the present disclosure. Obviously, the described embodiments are only a part of the embodiments of the present disclosure, rather than all embodiments.

In the description of the present disclosure, it should be understood that the terms "upper", "lower", "front", "rear", "left", "right", "top", "bottom", "inner", "outer", etc. indicate the orientation or the positional relationship is based on the orientation or positional relationship shown in the drawings, which is only for the convenience of describing the present disclosure and simplifying the description, and does not indicate or imply that the device or element referred to must have a specific orientation, be constructed and operated in a specific orientation. Therefore, it cannot be understood as a limitation of the present disclosure.

Figure 2:
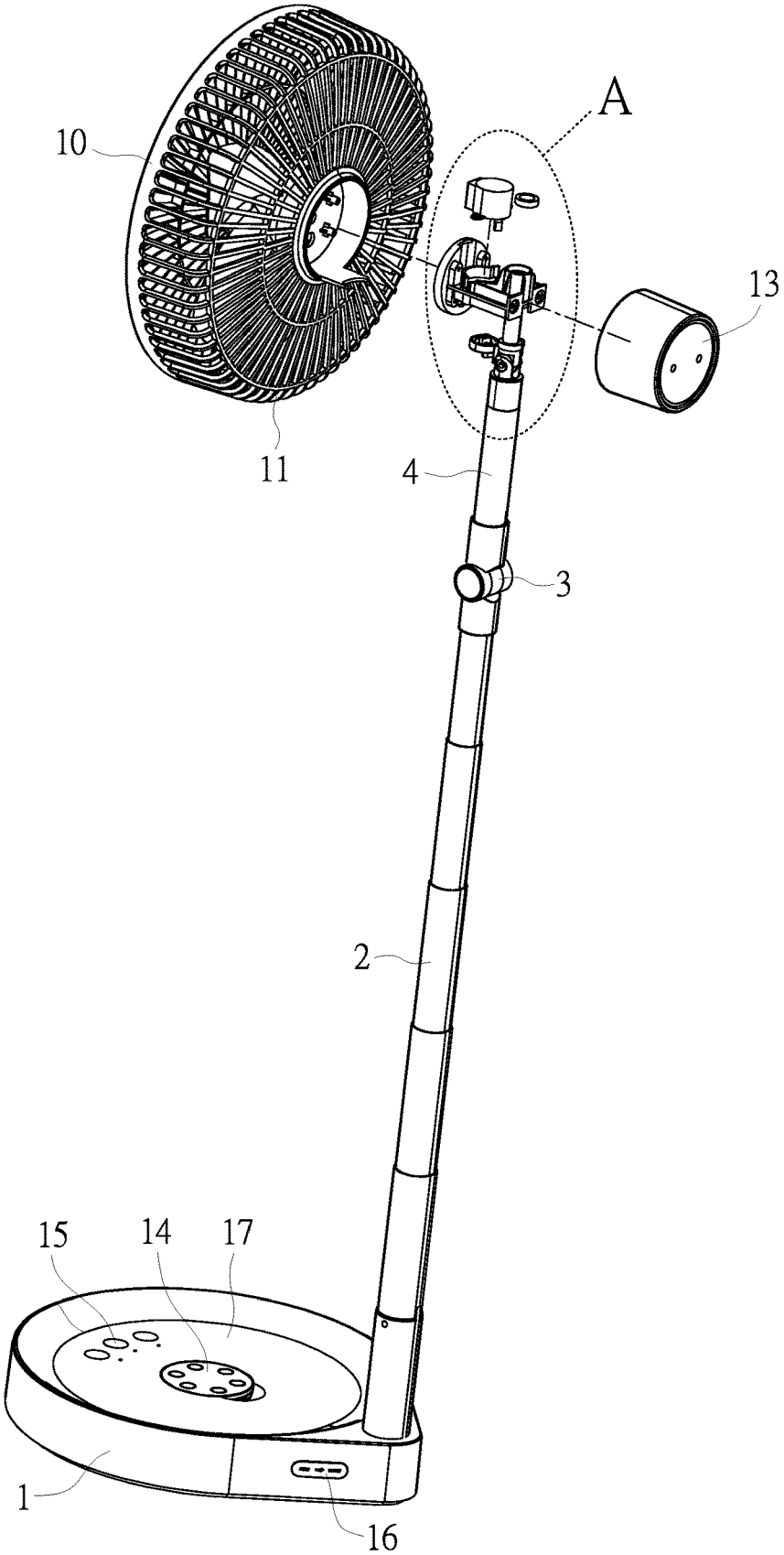
FIG. 2 is a schematic diagram of the explosive structure of a lifting oscillating fan which is convenient to store and carry proposed by the present disclosure.
Figure 3:
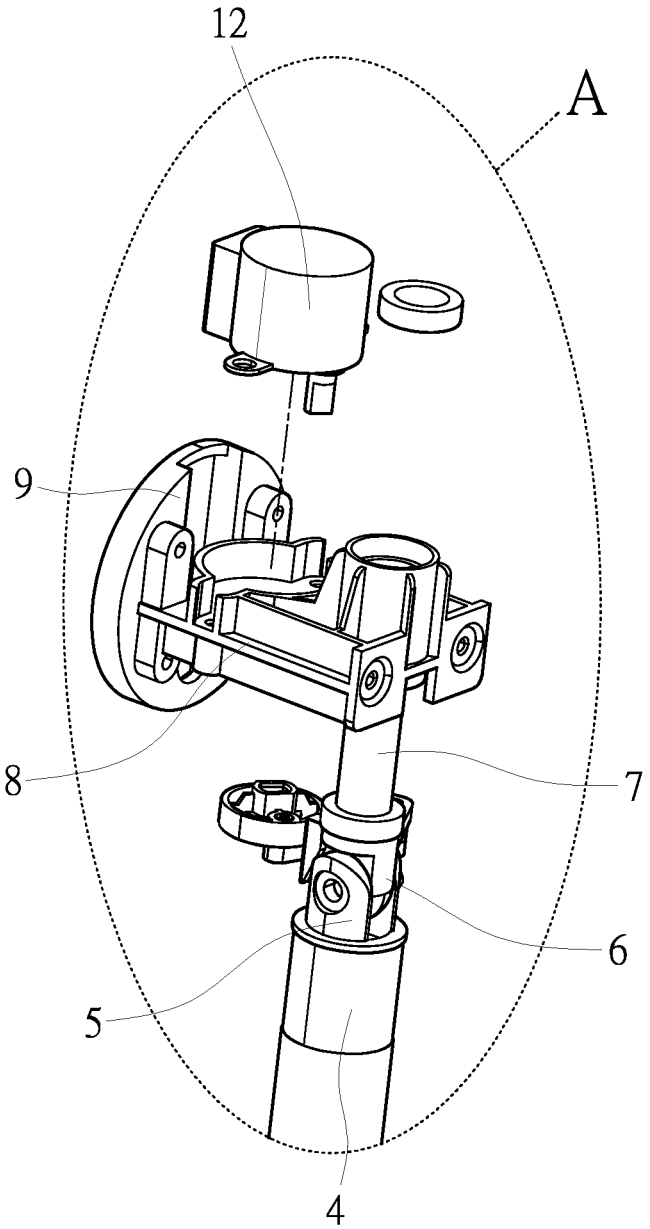
FIG. 3 is a schematic diagram of the structure of part A of a lifting oscillating fan which is convenient to store and carry proposed by the present disclosure.
Figure 4:
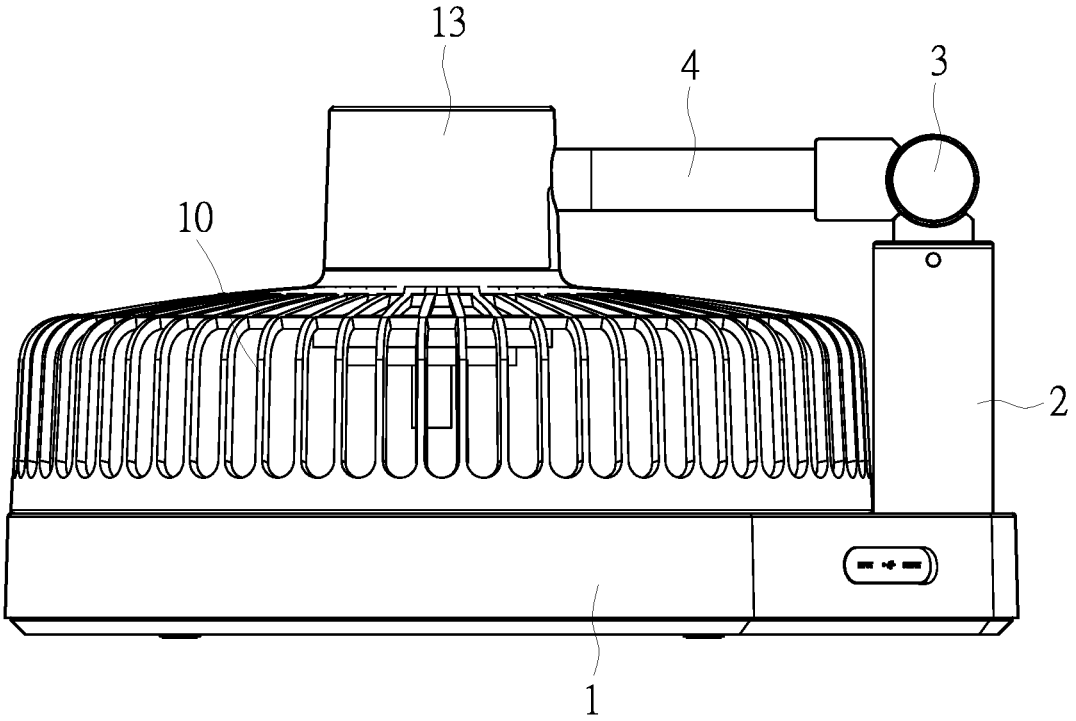
FIG. 4 is a schematic diagram of the folding and storing structure of a lifting oscillating fan which is convenient to store and carry proposed by the present disclosure.

Reference is made to FIGS. 1-4. A lifting oscillating fan which is convenient to store and carry is provided, comprising: a fan base 1, wherein one side of an upper end of the fan base 1 is fixedly connected to a first telescopic rod 2; an upper end of the first telescopic rod 2 is rotatably connected to a second telescopic rod 4 by means of a movable joint 3; an upper end of the second telescopic rod 4 is fixedly connected to a U-shaped support 5; inner walls of the opposite sides of the U-shaped support 5 are rotatably connected to a rotating rod 6 by means of a rotating shaft; an upper end of the rotating rod 6 is rotatably connected to a supporting rod 7 by means of a bearing; a head shaking support 8 is sheathed on an upper end of the supporting rod 7 in a fixed manner; one side of the head shaking support 8 is fixedly connected to a connecting plate 9; the head shaking support 8 is fixedly connected to a fan head 10 by means of the connecting plate 9; and a connecting cylinder 11 which is correspondingly connected to the connecting plate 9 is fixedly embedded in one side of the fan head 10; a motor 12 is arranged on an outer side of the head shaking support 8, an output shaft of the motor 12 is fixedly connected to the head shaking support 8, and an outer wall of the fan head 10 is further fixedly connected with a fan rear shell 13 that is arranged outside the head shaking support 8.

An upper surface of the fan base 1 is further provided with a remote control 14 and an operation button 15, and the operation button 15 is electrically connected to the motor 12 by means of the remote control 14.

A side wall of the fan base 1 is further provided with a charging interface 16.

An upper surface of the fan base 1 is further provided with a placement groove 17 for placing the fan head 10.

A dust-proof rubber pad is connected to the fan base 1 corresponding to the charging interface 16.

A plurality of heat dissipation holes are uniformly opened on a surface of the fan rear shell 13.

In the present disclosure, when in use, the relative height of the fan head 10 can be adjusted quickly and conveniently by the first telescopic rod 2 and the second telescopic rod 4, and the matching of the motor 12 and the head shaking support 8 can be embodied. The back and forth swing of the fan head 10 is convenient for people to use for blowing air, and when the overall fan needs to be moved, the first telescopic rod 2 and the second telescopic rod 4 are received to the shortest position, then the position of the fan head 10 is rotated by the rotating connection of the movable joint 3 so that the fan head is clamped down into the placement groove 17 on the surface of the fan base 10, and then the fan can be quickly folded, which greatly reduces the overall volume of the fan and is convenient for people to carry and use. The charging interface 16 can charge the fan, and the dustproof rubber pad can avoid the problem of dust entering the charging interface 16 for use when it is not required to be used for charging.

The above are only the preferred specific embodiments of the present disclosure, but the protection scope of the present disclosure is not limited to this. Any person familiar with the technical field within the technical scope of the present disclosure, based on the technical scheme of the present disclosure and the concept of the present disclosure to make equivalent replacements or changes, should be covered in the scope of protection of the present disclosure.

What is claimed is:

1. A lifting oscillating fan which is convenient to store and carry, comprising a fan base (1), wherein one side of an upper end of the fan base (1) is fixedly connected to a first telescopic rod (2), an upper end of the first telescopic rod (2) is rotatably connected to a second telescopic rod (4) by means of a movable joint (3), an upper end of the second telescopic rod (4) is fixedly connected to a U-shaped support (5), inner walls of the opposite sides of the U-shaped support (5) are rotatably connected to a rotating rod (6) by means of a rotating shaft, an upper end of the rotating rod (6) is rotatably connected to a supporting rod (7) by means of a bearing; a head shaking support (8) is sheathed on an upper end of the supporting rod (7) in a fixed manner, one side of the head shaking support (8) is fixedly connected to a connecting plate (9), the head shaking support (8) is fixedly connected to a fan head (10) by means of the connecting plate (9), a connecting cylinder (11) which is correspondingly connected to the connecting plate (9) is fixedly embedded in one side of the fan head (10), a motor (12) is arranged on an outer side of the head shaking support (8), an output shaft of the motor (12) is fixedly connected to the head shaking support (8), and an outer wall of the fan head (10) is further fixedly connected with a fan rear shell (13) that is arranged outside the head shaking support (8).

2. The lifting oscillating fan which is convenient to store and carry according to claim 1, wherein an upper surface of the fan base (1) is further provided with a remote control (14) and an operation button (15), and the operation button (15) is electrically connected to the motor (12) by means of the remote control (14).

3. The lifting oscillating fan which is convenient to store and carry according to claim 1, wherein a side wall of the fan base (1) is further provided with a charging interface (16).

4. The lifting oscillating fan which is convenient to store and carry according to claim 1, wherein an upper surface of the fan base (1) is further provided with a placement groove (17) for placing the fan head (10).

5. The lifting oscillating fan which is convenient to store and carry according to claim 3, wherein a dust-proof rubber pad is connected to the fan base (1) corresponding to the charging interface (16).

6. The lifting oscillating fan which is convenient to store and carry according to claim 1, wherein a plurality of heat dissipation holes are uniformly opened on a surface of the fan rear shell (13).

* * * * *